US006262007B1

(12) United States Patent
Scialla et al.

(10) Patent No.: US 6,262,007 B1
(45) Date of Patent: Jul. 17, 2001

(54) SELF-THICKENED CLEANING COMPOSITIONS

(75) Inventors: Stefano Scialla, Rome (IT); Peter Rosalia Joannes Geboes, Aartselaar (BE); Michel Jean Carrie, Strombeek-Bever (BE); Eddy Vos, Linden (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 08/162,063

(22) PCT Filed: Jun. 8, 1992

(86) PCT No.: PCT/US92/04772

§ 371 Date: May 3, 1994

§ 102(e) Date: May 3, 1994

(30) Foreign Application Priority Data

Jun. 14, 1991 (EP) ..... 91870095
Feb. 14, 1992 (EP) ..... 92870025

(51) Int. Cl.[7] ..... C11D 7/18; C11D 1/83

(52) U.S. Cl. ..... 510/372; 510/375; 510/421; 510/424; 510/426; 510/427; 510/477; 510/504

(58) Field of Search ..... 510/372, 375, 510/421, 424, 426, 427, 477, 504

(56) References Cited

U.S. PATENT DOCUMENTS

| | | | | |
|---|---|---|---|---|
| 4,333,862 | * | 6/1982 | Smith et al. | 252/550 |
| 4,371,461 | * | 2/1983 | Jones et al. | 252/550 |
| 4,412,934 | * | 11/1983 | Chung et al. | 252/95 |
| 4,661,267 | * | 4/1987 | Dekker et al. | 252/8.8 |
| 4,671,895 | * | 6/1987 | Erilli et al. | 252/550 |
| 4,702,857 | * | 10/1987 | Gosselink | 252/174.21 |
| 4,781,854 | * | 11/1988 | Overton et al. | 252/100 |
| 4,861,512 | * | 8/1989 | Gosselink | 252/174.23 |
| 5,118,436 | * | 6/1992 | Aoyagi et al. | 252/550 |

* cited by examiner

*Primary Examiner*—Margaret Einsmann
(74) *Attorney, Agent, or Firm*—Jason J. Camp

(57) ABSTRACT

Self-thickened aqueous cleaning compositions are described which comprise an alkyl sulfate anionic surfactant and an electrolyte system. The compositions are made physically stable, even at low temperature, by incorporating therein a nonionic surfactant from a selected class.

18 Claims, 1 Drawing Sheet

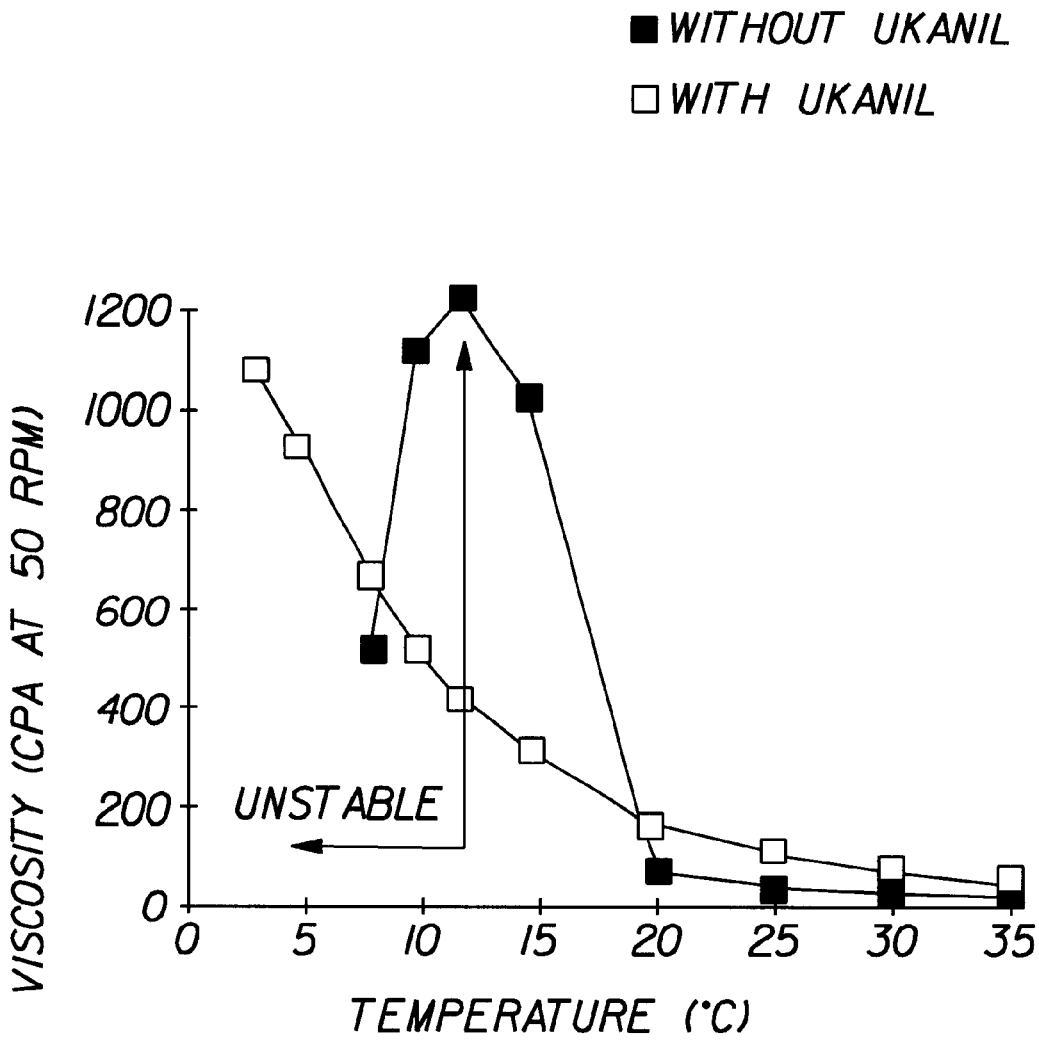
WITHOUT UKANIL
WITH UKANIL
1200
1000
800
600
400
200
0
VISCOSITY (CPA AT 50 RPM)
UNSTABLE
0
5
10
15
20
25
30
35
TEMPERATURE (°C)

SELF-THICKENED CLEANING COMPOSITIONS

TECHNICAL FIELD

The present invention relates to cleaning compositions. The compositions according to the present invention are self-thickened, in that they do not require the presence of a thickener compound; furthermore, the compositions according to the present invention are physically stable, even at low temperatures. The compositions according to the present invention are useful for instance as hard surface cleaning compositions or as laundry cleaning compositions.

BACKGROUND

Thickened cleaning compositions are well known in the art, and have found various applications for instance in the context of hard surface or laundry cleaning compositions.

The simplest way to make such compositions is to add a thickener on top of a non-viscous product. However, thickeners can be seen as undesirable in many respects, such as processing issues, long term product stability issues as well as other considerations related to formula cost. It is thus desirable to formulate a cleaning composition which is viscous, but does not necessarily contain a thickener.

The art teaches that it is possible to do so by using a system where viscosity is built by combining an anionic surfactant together with an electrolyte in an aqueous medium, wherein the viscosity can be adjusted by balancing both ingredients. This system is very often used in the formulation of shampoos, but has also found application in cleaning compositions. In theory, this solution can be used with any anionic surfactant, but the compositions of the present invention only use an alkyl sulfate anionic surfactant derived from natural coconut oil; indeed, this surfactant provides good performance and is particularly desirable for obvious environmental reasons.

Thus, self-thickened compositions can be made which comprise such an anionic surfactant derived from natural coconut oil and an electrolyte. The viscosity of such a composition is of course sensitive to temperature, and a new technical problem has been identified in that such compositions are not physically stable at low temperature, where the product undergoes phase separation; As a result, the product has an aesthetically unacceptable aspect.

It has now been found that this problem could be solved by using a specific electrolyte and adding to the system above a nonionic surfactant from a selected class.

Canadian patent CA 1 194 381 discloses scouring compositions containing anionic surfactants, an electrolyte and an ethoxylated alcohol surfactant.

European patent EP 116 905 teaches the use of an ethoxylated and/or propoxylated alcohol surfactant to reduce the viscosity of industrial-grade synthetic anionic surfactant concentrates.

European patent application EP 329 209 discloses scouring compositions comprising a surfactant, an electrolyte and a solvent to build viscosity.

SUMMARY OF THE INVENTION

The compositions according to the present invention are self-thickened aqueous cleaning compositions having a viscosity of from 50 to 700 cps at 60 rpm shear rate at 20° C., which comprise from 1% to 25% by weight of the total composition of an alkyl sulphate anionic surfactant derived from natural coconut oil, from 0.1% to 8% by weight of the total composition of ammonium salts and from 0.5% to 25% by weight of the total composition of a compound of the structure:

$$R_1—O—[(R_2O)_n(R_3O)_m]—R_4,$$ wherein $R_1$ is a $C_{1-25}$ alkyl or alkenyl group;
$R_2$ is a $C_{2-4}$ aliphatic hydrocarbon chain;
$R_3$ is a methyl or ethyl monosubstituted $C_2$–$C_4$ aliphatic hydrocarbon chain;
$R_4$ is a $C_{1-25}$ alkyl or alkenyl or carboxyl chain, or H;
n is an integer of from 1 to 10;
m is an integer of from 0 to 20; or mixtures thereof.

DETAILED DESCRIPTION OF THE INVENTION

The compositions according to the present invention comprise from 1% to 25% by weight of the total composition, preferably from 2% to 8% by weight of the total composition, most preferably 3% to 5% of an alkyl sulphate anionic surfactant derived from natural coconut oil, or mixtures thereof. Suitable alkyl sulphate anionic surfactants for use herein can be made by the processes well known to the man skilled in the art. Typically, such surfactants are made from coconut alcohol which is sulfated and possibly ethoxylated. Indeed, ethoxylated alkyl sulfate surfactants are also suitable for use herein, but the average degree of ethoxylation of the anionic surfactants to be used herein should not be more than 2.

The neutralizing cation for the alkyl sulfates derived from natural coconut oil to be used herein can be any of the conventional cations used in detergent technology, such as ammonium, potassium or unsubstituted or N-substituted ammonium salts, or mixtures thereof; preferred are the sodium salts.

The viscosity of the compositions according to the invention is obtained by using ammonium salts as an electrolyte; suitable ammonium salts for use in the compositions according to the invention include alkanolammonium salts, ammonium chloride, ammonium acetate, ammonium citrate, ammonium carbonate and the like; it is the electrolyte together with the above described surfactants which builds the viscosity. The viscosity of the composition depends on the proportion of both ingredients, the general rule being that the more electrolyte is added, the more viscosity is obtained. The compositions according to the present invention comprise from 0.1% to 8% by weight of the total composition of ammonium salts, preferably from 0.2% to 6%, most preferably 0.3% to 5%. The ratio of ammonium salts to anionic surfactant is adjusted so as to obtain a composition having a viscosity of from 50 to 700 cps at 60 rpm shear rate at 20,C, more preferably 80 cps to 350 cps. The viscosity of the compositions according to the invention allows to use said compositions on vertical surfaces.

Such a product comprising the surfactant and the electrolyte described herein above could be used as such, however, as described in the background part, physical stability of the product is not satisfactory under all conditions, in that the product undergoes phase separation at low temperatures, around 10° C. and below. It has now been found that this problem could be solved by simply adding to the composition a nonionic surfactant from a selected class. Accordingly, the compositions according to the present invention comprise from 0.5% to 25% by weight of the total composition, preferably from 0.6% to 10% , most preferably from 0.7% to 2% of a compound of the formula:

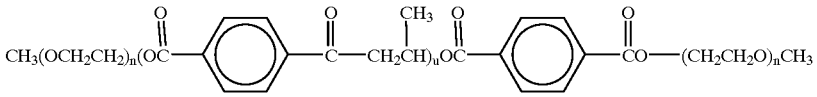

$R_1—O—[(R_2O)_n(R_3O)_m]—R_4$, wherein $R_1$ is a $C_{1-25}$ alkyl or alkenyl chain, preferably $C_{10-15}$, preferably alkyl;

$R_2$ is a $C_{2-4}$ aliphatic hydrocarbon chain, preferably $C_2$;

$R_3$ is a methyl or ethyl monosubstituted $C_2$–$C_4$ aliphatic hydrocarbon chain, preferably a methyl substituted ethylene;

$R_4$ is a $C_{1-25}$ alkyl or alkenyl or carboxyl chain, or H, preferably H;

n is an integer of from 1 to 10, preferably 1 to 5;

m is an integer of from 0 to 20; preferably 0 to 10, most preferably 0 to 3; or mixtures thereof.

It is to be understood that, in the chemical formula above, $R_2O$ and $R_3O$ groups may appear in any sequence in the molecule; also, when n and m are greater than 1, different $R_2O$ and $R_3O$ groups may appear in a same molecule. These surfactant are commercially available from ICI under the trade name UKANIL FM®, or from BASF under the trade name PLURAFAC LF®. Preferred surfactant where m is 0 are available from SHELL under the trade name DOBANOL® or from BASF under the trade name LUTENSOL®.

The compositions according to the invention are acidic and have a pH of from 1 to 6, preferably 2.5 to 5. The pH of the compositions according to the invention is partially determined by the amount of electrolyte, but the pH of the final composition can be adjusted by the addition of appropriate acidifiers such as organic or inorganic acids, or acidic salts which buffer pH to an acid value. Examples of suitable acidifiers are sulfuric acid, phosphoric acids, although somewhat undesirable from an environmental viewpoint, hydrochloric acid, phosphonic acid, citric acid, acetic acid, tartaric acid, maleic acid, succinic acid, malonic acid and the like, or mixtures thereof.

In a particularly preferred embodiment of the invention, the compositions comprise from 0.5% to 20% by weight of the total composition of citric acid, preferably from 1% to 10%. Indeed, it has been found there are many benefits obtainable from the addition of citric acid to the compositions according to the present invention, such as limescale removal performance and improved disinfesting properties. When citric acid is used in the compositions according to the invention, it is possible to form in situ the ammonium salts described herein above, in this case ammonium citrate by incorporating ammonium hydroxide. The presence of citric acid also helps to build the product's viscosity; When high levels of citric acid are used to obtain optimal performances, it may be necessary to adjust the pH of the composition by adding an alkalinizing agent.

In a preferred embodiment, the compositions according to the invention further comprise from 0.01% to 0.5% by weight of the total composition of a capped 1,2-propylene terephthalate polyoxyethylene polyester of the formula:

wherein n is an integer of from about 12 to 43 and u is an integer of from about 2 to 8, and mixtures thereof. These polymers have been extensively described as soil release agents in softening compositions and in liquid detergent compositions and in EP 185 427 and EP 220 156. However, it has now been found that, the above polymers have a regulating effect on the viscosity of the compositions; indeed, the viscosity of a given product is typically very sensitive to temperature, and the compositions according to the present invention, although they remain phase-stable at all temperatures, tend to become more viscous when temperature drops. IT has now been found that the above polymers make the composition's viscosity less sensitive to temperature; thus the compositions have less tendency to become thicker at low temperatures.

In a preferred embodiment, the compositions according to the present invention further comprise from 1% to 15% by weight of the total composition, preferably from 2% to 10%, most preferably 3% to 8% of hydrogen peroxide. In the compositions of the prior art, i.e. viscous systems consisting of an anionic surfactant and an electrolyte, the addition of hydrogen peroxide leads to a severe drop in viscosity; another advantage of the compositions according to the present invention, i.e. comprising the stabilizing nonionic surfactant from the selected class, is that the addition of hydrogen peroxide has little effect on the product's viscosity. Thus, bleaching compositions can also be made according to the present invention.

The compositions according to the present invention may also comprise conventional ingredients such as solvents, chelating agents, fragrance and dyes, provided all these ingredients are compatible with the compositions.

The compositions according to the present invention can be made by any process where all ingredients are mixed together. However, in the preferred embodiment where the compositions comprise a substantial amount of citric acid, it is preferred to use a process which comprises the steps of dissolving the citric acid in water separately from the remainder of the composition, adjusting the pH of the citric acid solution to the target pH value of the final composition, and adding said pH-adjusted citric acid solution to the remainder of the composition, the pH of which having been separately adjusted to said target pH value. In case the compositions also comprise hydrogen peroxide, it is preferred to add the hydrogen peroxide as a final step in the process, on top of the remainder of the composition including the citric acid.

The compositions according to the present invention can be useful in many different contexts where it is desirable to use a viscous product. For instance, hard surface cleaning compositions are advantageously formulated as viscous products in order to optimize their application to vertical surfaces, for instance baththubs or toilet bowls. Indeed, the product's viscosity prevents the product from running too quickly down said surface.

The compositions according to the present invention can also be used in the context of laundry cleaning. For instance, a laundry pretreatment composition can be advantageously formulated as a viscous product for a most convenient application to the laundry fabrics. Indeed, the viscosity of the product allows for a better control of the dispensing of the product and prevents the spreading of the dispensed product beyond the fabric surface being pretreated.

The following examples will further illustrate the present invention.

EXAMPLES

The following compositions are made, which contain the listed ingredients in the listed proportions (weight %).

| Compositions: | 1 | 2 | 3 | 4 | 5 | 6 |
|---|---|---|---|---|---|---|
| NaCnAS | 3.5 | 3.5 | 3.5 | 4.0 | 2.4 | 3.5 |
| Citric Acid | 5.8 | 6.0 | 5.8 | — | 4.0 | 5.7 |
| Ukanil $^R$ | 1.5 | 1.5 | 1.0 | 1.0 | 2.0 | — |
| Dobanol $^R$ 23-3 | — | — | — | — | — | 0.9 |
| Ammonia | 0.6 | 0.6 | 0.7 | — | — | 0.32 |
| Ammonium Chloride | — | — | — | — | 1.0 | — |
| Sodium Chloride | — | — | — | 4.0 | — | — |
| Tri Ethanol Amine | — | — | 1.5 | — | — | 2.0 |
| Hydrogen Chloride | — | — | — | 0.05 | — | — |
| Hydrogen Peroxide | — | 6.0 | — | — | — | — |
| Sodium Cumene Sulphonate | 1.0 | — | — | — | — | — |
| Perfume | 0.5 | — | 0.5 | — | — | 0.4 |
| pH | 4.1 | 4.0 | 4.5 | 2.5 | 2.2 | 3.6 |
| Water & minors | | | up to 100% | | | |

Data

The following data illustrates the benefits obtained from the compositions according to the present invention. A composition is made which comprises, by weight of the total composition:

| | |
|---|---|
| Sodium coconut alkyl sulfate: | 3.5% |
| Ammonia: | 0.75% |
| Citric acid: | 5.8 |
| pH: | 4.3 |
| Water & minors: | up to 100% |

An identical composition is also made, except it comprises in addition 1.5% of Ukanil $^R$.

The viscosity of both compositions is then measured at 60 rpm shear rate, at different temperatures. The results are reported in FIG. 1. This graph shows that the composition without Ukanil R presents the phase stability problem as from 13° C. and below, whereas in the same time, the composition with Ukanil $^R$ raises in viscosity as the temperature decreases, but remains stable. Also, one can notice that, at all temperatures, the composition with Ukanil $^R$ is somewhat more viscous than the composition without.

What is claimed is:

1. A self-thickened aqueous cleaning composition having a viscosity of from 50 to 700 cps at 60 rpm shear rate at 20° C., comprising from 1% to 25% by weight of the total composition of an alkyl sulphate anionic surfactant derived from natural coconut oil, from 0.1% to 8% by weight of the total composition of ammonium salts; from 0.5% to 25% by weight of the total composition of a compound of the structure:

$$R_1—O—[(R_2O)_n(R_3O)_m]—R_4, \text{ wherein:}$$

$R_1$ is a $C_{1-25}$ alkyl or alkenyl group;
$R_2$ is a $C_{2-4}$ aliphatic hydrocarbon chain;
$R_3$ is a methyl or ethyl monosubstituted $C_2$–$C_4$ aliphatic hydrocarbon chain;
$R_4$ is a $C_{1-25}$ alkyl or alkenyl or carboxyl chain, or H;
n is an integer of from 1 to 10;
m is an integer of from 0 to 20;
or mixtures thereof, and
from 0.01% to 0.5% by weight of the total composition of a capped 1,2-propylene terephthalate polyoxyethylene terephthalate polyester of the formula:

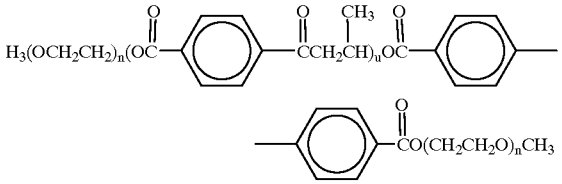

wherein n is an integer of from about 12 to 43 and u is an integer of from about 2 to 8, or mixtures thereof.

2. A composition according to claim 1, wherein
$R_1$ is a $C_{10-15}$ alkyl chain;
$R_2$ is ethylene;
$R_3$ is a methyl substituted ethylene;
$R_4$ is H;
n is an integer of from 1 to 5;
m is an integer of from 0 to 10 or mixtures thereof.

3. A composition according to claim 1 which comprises from 0.6% to 10% by weight of the total composition of said compound.

4. A composition according to claim 1 which comprises from 2% to 8% by weight of the total composition of said alkyl sulphate anionic surfactant.

5. A composition according to claim 1 which comprises from 0.2% to 6% by weight of the total composition of ammonium salts.

6. A composition according to claim 1 which has a viscosity in the range of from 80 cps to 350 cps at 60rpm shear rate at 20° C.

7. A composition according to claim 1 which has a pH as is in the range of from 1 to 6.

8. A composition according to claim 7 which has a pH as is in the range of from 2.5 to 5.

9. A composition according to claim 1 which further comprises from 0.5% to 20% by weight of the total composition of citric acid.

10. A composition according to claim 1 which further comprises from 1% to 15% by weight of the total composition of hydrogen peroxide.

11. A process for the manufacturing of a composition according to claim 9 which comprises the steps of dissolving the citric acid in water separately from the remainder of the composition, adjusting the pH of the citric acid solution to the target pH value of the final composition, and adding said pH adjusted citric acid solution to the remainder of the composition, the pH of which having been separately adjusted to said pH target value.

12. A process according to claim 11 wherein, as a final step hydrogen peroxide is added on top of the remainder of the composition including the citric acid.

13. The composition according to claim 3 wherein said compound is from 0.7% to 2% by weight of the total composition.

14. The composition according to claim 4 wherein said alkyl sulphate anionic surfactant is from 3% to 5% by weight of the total composition.

15. The composition according to claim 5 wherein said ammonium salts is from 0.2% to 6% by weight of the total composition.

16. The composition according to claim 10 wherein said hydrogen peroxide is from 2% to 10% by weight of the total composition.

17. The composition according to claim 16 wherein said hydrogen peroxide is from 3% to 8% by weight of the total composition.

18. A composition according to claim 2 wherein m is 0 to 3.

* * * * *